US010135144B2

(12) United States Patent
Bosshard et al.

(10) Patent No.: US 10,135,144 B2
(45) Date of Patent: Nov. 20, 2018

(54) ARCHITECTURE FOR AN ANTENNA WITH MULTIPLE FEEDS PER BEAM AND COMPRISING A MODULAR FOCAL ARRAY

(71) Applicant: THALES, Courbevoie (FR)

(72) Inventors: Pierre Bosshard, Tournefeuille (FR); Jean-Christophe Odin, Toulouse (FR); Olivier Saint Martin, Toulouse (FR); Daniel Andrieu, Toulouse (FR)

(73) Assignee: THALES, Courbevoie (FR)

( * ) Notice: Subject to any disclaimer, the term of this patent is extended or adjusted under 35 U.S.C. 154(b) by 258 days.

(21) Appl. No.: 15/136,755

(22) Filed: Apr. 22, 2016

(65) Prior Publication Data

US 2016/0315391 A1 Oct. 27, 2016

(30) Foreign Application Priority Data

Apr. 24, 2015 (FR) ..... 15 00871

(51) Int. Cl.

| | |
|---|---|
| ***H01Q 3/00*** | (2006.01) |
| ***H01Q 13/02*** | (2006.01) |
| ***H01Q 1/28*** | (2006.01) |
| ***H01Q 21/00*** | (2006.01) |
| ***H01Q 21/06*** | (2006.01) |

(Continued)

(52) U.S. Cl.

CPC ..... *H01Q 13/02* (2013.01); *H01Q 1/288* (2013.01); *H01Q 3/40* (2013.01); *H01Q 21/0006* (2013.01); *H01Q 21/0025* (2013.01); *H01Q 21/06* (2013.01); *H01Q 21/064* (2013.01); *H01Q 25/007* (2013.01)

(58) Field of Classification Search

CPC ..... H01Q 1/288; H01Q 3/02; H01Q 3/40; H01Q 21/0006

USPC ..... 342/81, 154, 368, 373; 343/772, 786, 343/835

See application file for complete search history.

(56) References Cited

U.S. PATENT DOCUMENTS

| | | | |
|---|---|---|---|
| 6,198,456 | B1 | 3/2001 | Le Halle et al. |
| 8,493,161 | B2 | 7/2013 | Bosshard et al. |
| 9,306,295 | B2 | 4/2016 | Bosshard et al. |

(Continued)

FOREIGN PATENT DOCUMENTS

| | | |
|---|---|---|
| EP | 2822095 A1 | 7/2015 |
| FR | 2764738 A1 | 12/1998 |

(Continued)

*Primary Examiner* — Dao L Phan

(74) *Attorney, Agent, or Firm* — Baker & Hostetler LLP

(57) ABSTRACT

An MFPB antenna comprises a plurality of RF feeds with four ports and a BFN, the number of feeds per beam being equal to four, and a single structural interface board, covering all of the ports of the RF feeds, and comprising a plurality of through waveguides. The through waveguides are positioned according to a matrix with multiple rows and multiple columns. The RF feeds are grouped into subassemblies that are respectively integrated in various independent cluster sources mounted one beside the other on the front face of the interface board, the ports of the RF feeds of each cluster source being connected to the through waveguides. The BFN is composed of multiple independent linear partial BFNs, mounted side by side on the back face of the interface board, the various ports of the power combiners that are integrated in each linear partial BFN being connected to the through waveguides.

5 Claims, 4 Drawing Sheets

(51) Int. Cl.
*H01Q 3/40* (2006.01)
*H01Q 25/00* (2006.01)

(56) References Cited

U.S. PATENT DOCUMENTS

| | | | | |
|---|---|---|---|---|
| 2009/0315796 | A1 | 12/2009 | Kodama | |
| 2010/0060521 | A1* | 3/2010 | Hayes | H01Q 1/38 342/368 |
| 2014/0022138 | A1 | 1/2014 | Bosshard et al. | |

FOREIGN PATENT DOCUMENTS

| | | | |
|---|---|---|---|
| FR | 2939971 | A1 | 12/2008 |
| FR | 2993716 | A1 | 7/2012 |

* cited by examiner

ARCHITECTURE FOR AN ANTENNA WITH MULTIPLE FEEDS PER BEAM AND COMPRISING A MODULAR FOCAL ARRAY

CROSS-REFERENCE TO RELATED APPLICATION

This application claims priority to foreign French patent application No. FR 1500871, filed on Apr. 24, 2015, the disclosure of which is incorporated by reference in its entirety.

FIELD OF THE INVENTION

The present invention relates to an architecture for an antenna with multiple feeds per beam and comprising a modular focal array. It is applicable to the area of space applications such as telecommunications by satellite and more particularly to MFPB (Multiple Feeds Per Beam) antenna systems placed on board a satellite in order to ensure multibeam coverage.

BACKGROUND

In an MFPB antenna with multiple radiofrequency RF feeds per beam, each beam is formed by combining the ports of multiple radiofrequency feeds of a focal array, each radiofrequency feed being composed of a radiating element connected to a transmission and reception radiofrequency chain that generally has two ports. For this purpose, the RF feeds of the focal array are grouped into a plurality of elementary cells comprising the same number of RF feeds and forming a mesh. According to the placement of the radiofrequency feeds in the focal array and the number of radiofrequency feeds in each mesh cell, the mesh cell may have various geometric forms, square or hexagonal for example. The ports of the radiofrequency feeds of each mesh cell may then be mutually combined in order to form a beam. In order to obtain a good overlap of the beams, it is known practice to reuse one or more radiofrequency feeds to form adjacent beams. The reuse of the radiofrequency feeds is generally implemented in two spatial dimensions, which conventionally requires the use of a complex beam forming network BFN comprising axially positioned power combiner circuits that criss-cross each other, and it is then impossible to physically separate the combiner circuits dedicated to the formation of different beams. This difficulty is compounded by the use of shared couplers with multiple radiofrequency feeds, which allow the radiofrequency feeds to be reused and the mutual independence of the beams. It is therefore not possible to construct and assemble these antennas in a modular form and the number of beams that may be formed is limited.

The document FR 2 939 971 describes an especially compact radiofrequency feed comprising an RF chain with four ports, two of which are transmission ports respectively operating in two polarizations P1, P2 that are orthogonal to one another and two of which are reception ports respectively operating in the two polarizations P1 and P2. The transmission ports and the reception ports respectively operate in two different frequency bands F1 and F2. This radiofrequency feed comprising four independent ports allows two independent beams to be formed on transmission and on reception.

The document FR 2 993 716 describes an architecture for an MFPB transmission and reception antenna comprising a focal array equipped with compact radiofrequency feeds with four ports, in which each beam is produced by a group of four radiofrequency feeds of the array, by combining in fours the ports with the same polarization and the same frequency of each of the four radiofrequency feeds. This antenna operates in transmission and in reception, and two adjacent beams operating in orthogonal polarizations are produced by two different groups of RF feeds, each composed of four radiofrequency feeds that are able to share one or two radiofrequency feeds according to the arrangement of the four RF feeds in the mesh cell. This architecture allows the radiofrequency feeds to be reused only in a single spatial dimension and requires the use of a second, identical antenna in order to obtain a good overlap of the beams in both spatial dimensions. This antenna architecture is therefore particularly simple as two adjacent beams are implemented by combinations of different ports, thereby allowing the use of independent BFNs, each BFN comprising combination circuits dedicated to the formation of a single beam. However, this document gives no information on a possibility of constructing the focal array of the antenna in a modular form, nor on the possibility of assembling the feeds and the BFNs without the components of the various BFNs overlapping.

SUMMARY OF THE INVENTION

The aim of the invention is to overcome the problems of known MFPB antennas and to implement a new MFPB antenna architecture the size of which may be adjusted according to needs, without limitation, comprising a focal array that is completely modular allowing a very large number of beams to be produced, each elementary module being functional and independent of the other modules, the various elementary modules being able to be assembled in a simple manner on a single mating plane, with no overlap between the components of the various modules and hence with no hyperstatic constraint.

To this end, the invention relates to an antenna with multiple feeds per beam comprising a focal array equipped with a plurality of radiofrequency RF feeds and a beam forming network BFN, each RF feed comprising a radiating horn linked to an RF transmission and reception chain, two transmission ports respectively operating in two different polarizations that are orthogonal to one another and two reception ports respectively operating in said two different polarizations, the number of RF feeds per beam being equal to four. The focal array and the beam forming network are modular, the RF feeds being grouped into subassemblies that are respectively integrated in various cluster sources that are independent of one another, each comprising at least four RF feeds and the beam forming network BFN comprising multiple independent linear partial BFNs. The antenna furthermore comprises a single structural interface board comprising a front face on which the various cluster sources are mounted, positioned next to one another, and a back face on which the linear partial BFNs are mounted side by side, the structural board comprising a plurality of through waveguides that end on the two front and back faces to which, on the one hand, the various ports of the RF feeds of each cluster source and, on the other hand, corresponding ports of the linear partial BFNs are respectively connected, the corresponding ports of the RF feeds and of the partial BFNs being mutually linked via the through waveguides of the interface board.

Advantageously, each cluster source may be composed of a stack of multiple planar layers, each planar layer being composed of two complementary metal half-shells that are assembled together, the two half-shells of each planar layer integrating radiofrequency components of the RF chains of all of the RF feeds of the cluster source, each RF chain being connected to a corresponding radiating horn.

Advantageously, the through waveguides of the interface board may be respectively positioned according to a matrix with multiple rows and multiple columns and the transmission and reception ports of the RF chains may all have the same orientation.

Advantageously, the adjacent RF feeds in the focal array have transmission ports and reception ports that are respectively linked in fours by the power combiners integrated in the linear partial BFNs, two groups of four consecutive feeds in the focal array sharing two common feeds along a single direction of the focal array and the linear partial BFNs extend in parallel to said direction of the focal array corresponding to the sharing of feeds.

Advantageously, the interface board may comprise, on the periphery of the focal array, available through waveguides that are connected to transmission and reception ports of RF feeds but not connected to ports of a linear partial BFN, the available through waveguides comprising an absorbent material containing carbon.

BRIEF DESCRIPTION OF THE DRAWINGS

Other particularities and advantages of the invention will become apparent in the remainder of the description that is given by way of purely illustrative and non-limiting example, with reference to the appended schematic drawings that represent.

DETAILED DESCRIPTION

The invention relates to an architecture for an antenna operating in transmission and in reception. The formation of the beams is therefore implemented in the two transmission and reception frequency bands. However, in order to obtain a good overlap of the beams in both spatial directions, it is necessary to use two antennas that are dedicated to the two frequency bands, both antennas having an identical architecture. The remainder of the description is limited to a single antenna operating in transmission and in reception.

Figure 1:
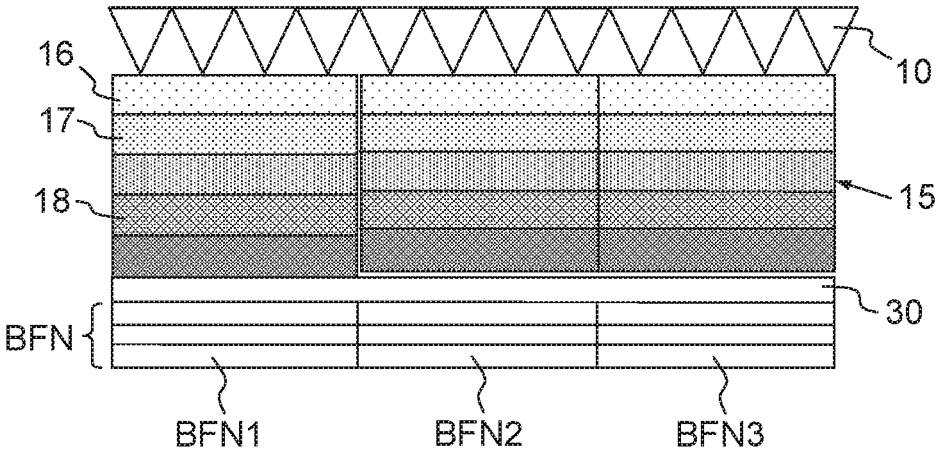
FIG. 1: a diagram, in cross section, of an exemplary modular focal array, according to the invention.
Figure 2A:
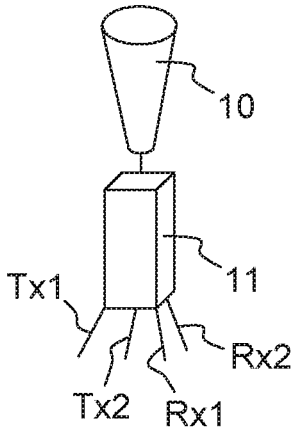
FIGS. 2*a* and 2*b*: two diagrams, in perspective and as a bottom view, respectively illustrating an exemplary RF feed with four ports and an exemplary positioning of the four ports, according to the invention.
Figure 2B:
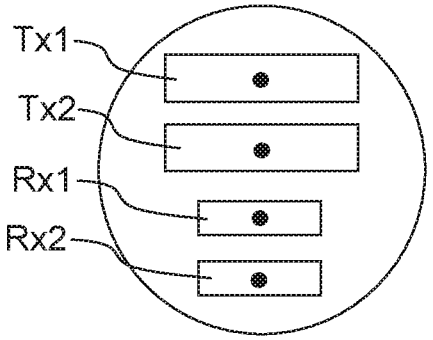
Figure 3A:
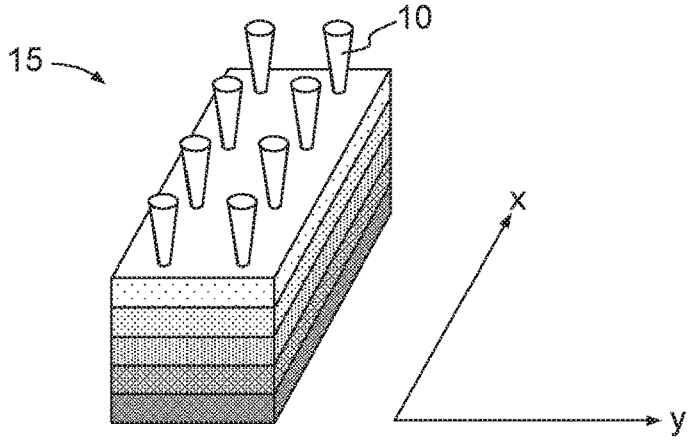
FIG. 3*a*: a diagram, in perspective, of an exemplary cluster source, according to the invention.

FIG. 1 is a diagram, in cross section, illustrating an exemplary modular focal array, according to the invention. The focal array comprises a plurality of cluster sources 15, a plurality of beam forming subnetworks, BFN1, BFN2, BFN3, called partial BFNs, and a structural interface board 30 covering all of the ports of the RF feeds. Each cluster source comprises a subassembly of multiple radiofrequency RF sources, comprising RF transmission Tx and reception Rx chains that are completely integrated. All of the cluster sources 15 comprise an identical number of N RF feeds, where N is an integer greater than or equal to four, arranged according to a matrix comprising at least two rows and at least two columns. By way of non-limiting example, FIG. 3*a* illustrates a cluster source comprising eight RF feeds arranged in four rows and two columns. According to the invention, as shown in FIGS. 2*a* and 2*b*, each RF feed comprises a radiating horn 10 that is connected to an RF chain 11 equipped with four transmission or reception ports Tx1, Tx2, Rx1, Rx2, the RF chain possibly being, for example, similar to that described in the document FR 2 993 716. Each RF chain comprises a diplexing orthomode transducer OMT and filters. Formation and the circular polarization is ensured by couplers and/or by a polarizer for the reception ports Rx. Alternatively, the RF chain may be designed to operate in linear polarization. Advantageously, so that each cluster source is as compact as possible, the various RF chains may be manufactured in two complementary parts, called half-shells, via a known machining technique, the two half-shells subsequently being assembled together by any type of known join, conventionally by screws or, alternatively, by soldering or by bonding.

Advantageously, all of the RF chains integrated in one and the same cluster source may be machined together, one next to the other, in metal half-shells common to all the RF feeds of the cluster source. In this case, the assembly of a cluster source consists in assembling the half-shells in twos, then stacking the assembled shells in different planar layers 16, 17 and lastly, stacking and assembling additional planar layers 18 containing the couplers and the axial polarizers. The manufacture of all of the radiofrequency components by machining into metal parts common to all of the RF feeds provides a very high level of robustness of each RF chain with respect to discrepancies in performance linked to the manufacture of components. Specifically, as all of the components corresponding to one and the same frequency band are localized in one and the same physical layer, all of the electrical paths that are dedicated to the two polarizations of each RF chain are symmetrical and therefore induce the same phase dispersion.

Each cluster source then has the advantage of having a planar multilayer architecture comprising a first level composed of the radiating elements, horns for example, a second level comprising the RF chains connected to the various horns, and three levels integrating couplers and axial polarizers.

Figure 3B:
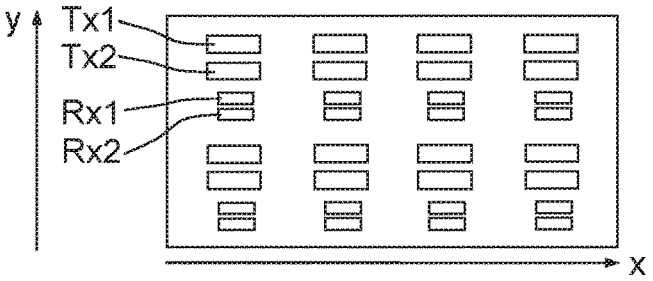
FIGS. 3*b* and 3*c*: two diagrams, as bottom views, of two exemplary arrangements of the ports of the cluster source of FIG. 3*a*, according to invention.
Figure 3C:
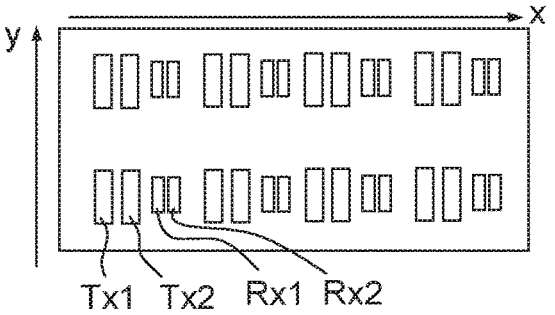
Figure 5A:
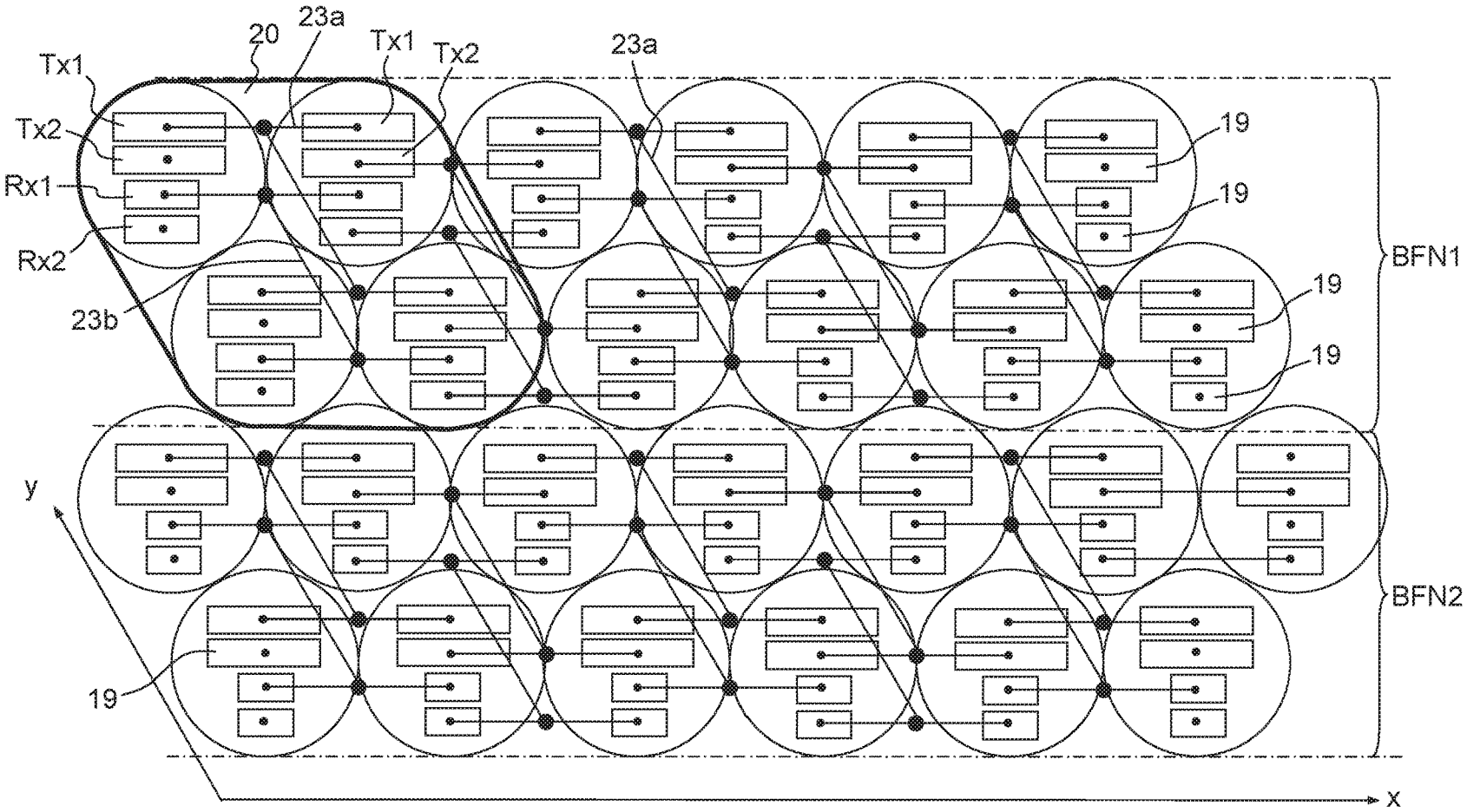
FIG. 5*a*: a diagram, as a partial bottom view, illustrating an exemplary position of the partial BFNs and the various groups of ports combined on a structural interface board, according to the invention.
Figure 5B:
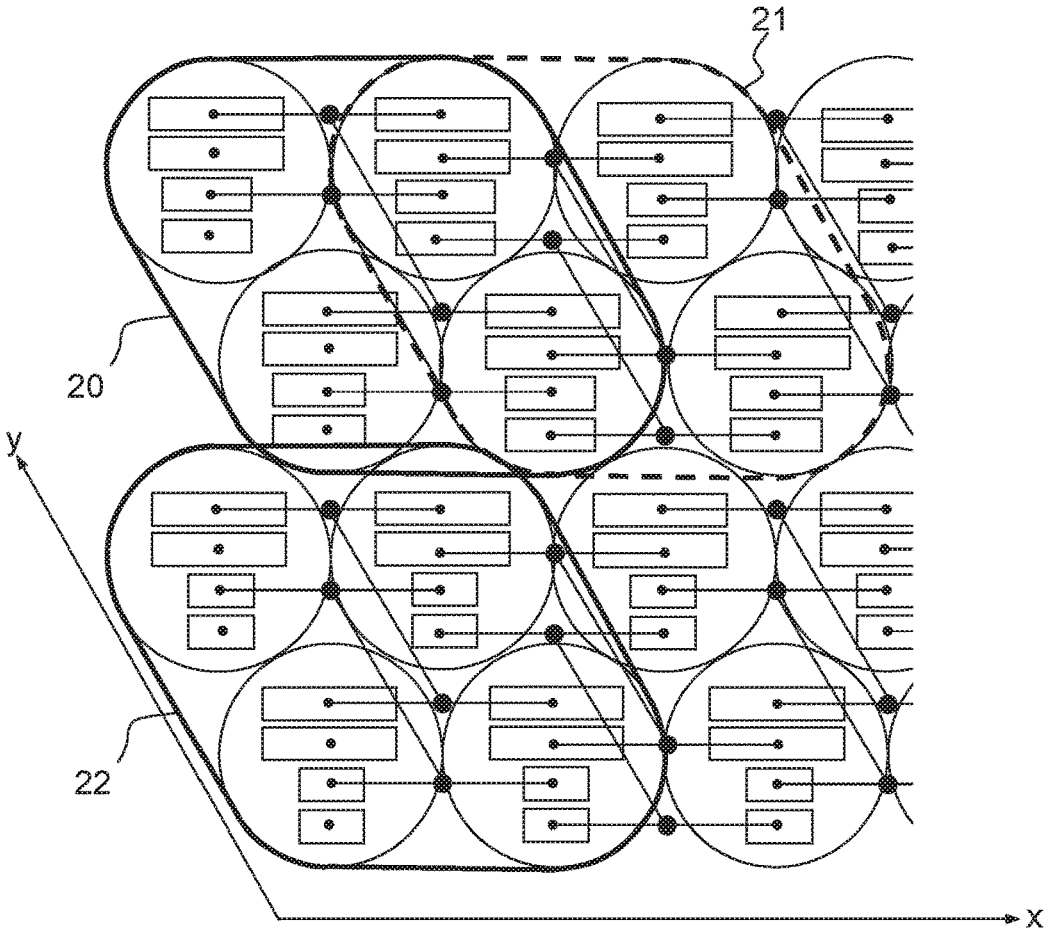
FIG. 5*b*: a detailed view of two groups of adjacent feeds sharing two RF feeds with the combination of the ports in order to form two transmission beams and two reception beams, according to the invention.

As shown in the two arrangements illustrated as bottom views in FIGS. 3*b* and 3*c*, the four transmission Tx1, Tx2 and reception Rx1, Rx2 ports of each RF feed are arranged side by side on the back face of the cluster source 15. The ports corresponding to the various RF feeds are oriented so as to be parallel to one another and are arranged according to a matrix, in the same arrangement of rows and columns as the radiating horns of the corresponding RF feeds, for example four rows and two columns in the case of FIGS. 3*a*, 3*b* and 3*c*. The only difference between the two arrangements shown in FIGS. 3*b* and 3*c* pertains to the direction of orientation of the ports, which may be implemented along a direction X corresponding to the direction of the rows, or along a direction Y corresponding to the direction of the columns, the directions X and Y possibly being orthogonal in the case of a square mesh cell as shown in FIGS. 3*b* and 3*c*, or being oriented at 30° or at 60° in the case of a hexagonal mesh cell as shown in FIGS. 5*a* and 5*b*. In the arrangement shown in FIG. 3*b*, in each row, for all of the RF feeds, the ports corresponding to the same frequency and to the same polarization are positioned in the same order and are therefore mutually aligned. In the arrangement shown in FIG. 3*c*, in each column, for all of the RF feeds, the ports corresponding to the same frequency and to the same polarization are positioned in the same order and are therefore mutually aligned. Of course, the designations "row" and "column" are arbitrary and may be inverted without the invention being modified.

Figure 4:
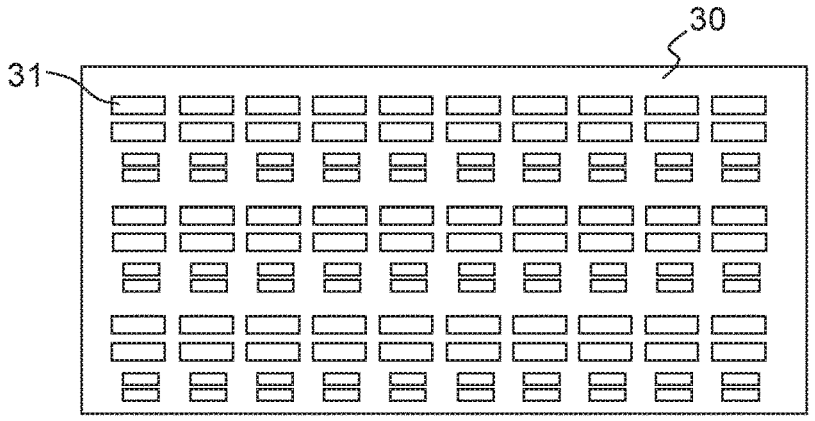
FIG. 4: a diagram illustrating an arrangement of the through-holes ending on the front and back faces of a structural interface board, according to the invention.

The various ports of the RF feeds that are integrated in each cluster source 15 are intended to be connected to corresponding through waveguides 31 that are open at their two opposite ends and that are set in the structural interface board 30 common to all of the cluster sources 15 of the focal array of the antenna. The dimensions of the structural interface board 30 correspond to the dimensions of said focal array and hence cover the entirety of the surface of the focal array. The structural interface board 30 comprises at least as many through waveguides 31 as there are RF feed ports to be connected, the through waveguides ending on two opposite faces, respectively front and back, of the structural interface board. The positioning of the through waveguides is identical to the matrical positioning of the ports of the cluster sources, as shown in FIG. 4. Thus, all of the cluster sources 15 are mounted side by side on a front face of the structural interface board, with no mutual overlap, and all of the ports of the RF feeds that are integrated in the cluster sources are connected to respective through waveguides that are integrated in the structural interface board.

As shown in FIGS. 5*a* and 5*b*, each beam is produced by a group 20, 21, 22 of four RF feeds of the focal array, the four RF feeds being positioned according to a matrix with two rows and two columns, by combining, via the through waveguides 31 of the interface board 30, the ports with the same polarization and the same frequency of each of the four RF feeds. In each group of four RF feeds, only one of the transmission ports, Tx1 for example, and only one of the reception ports, Rx1 for example, of each RF feed are combined with the corresponding ports of the other three RF feeds of the group by dedicated power combiners 23*a*, 23*b*. Thus, with each group of four RF feeds, one transmission beam and one reception beam are produced. As each RF feed comprises two transmission ports and two reception ports, there therefore remains one available transmission port Tx2 and one available reception port Rx2 that may be used to form another transmission beam and another reception beam with RF feeds of another adjacent group.

Two adjacent beams operating in orthogonal polarizations are produced by two groups of adjacent RF feeds, each composed of four RF feeds. The combined ports in the two adjacent groups 20, 21 have the same frequency but different polarizations. For this purpose, in transmission and reception, the second available port is combined with corresponding ports of a group of four adjacent RF feeds. Along one direction of the focal array, along the direction X for example, the two adjacent groups 20, 21 comprise two feeds in common and hence share two out of the four RF feeds. In the other direction, the direction Y for example, no RF feed is shared between the groups of adjacent feeds 20, 22. The reuse of two out of the four RF sources is therefore implemented along a single direction of the focal array.

Figure 6:
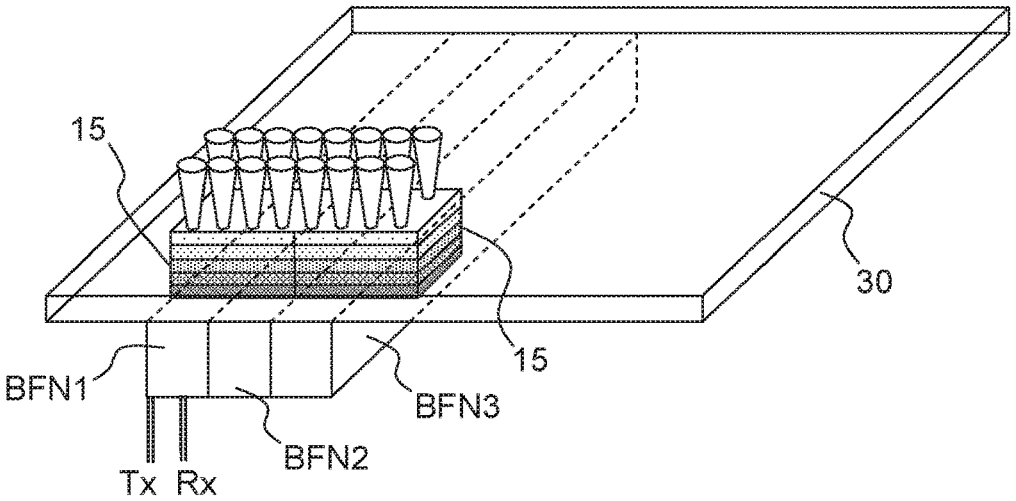
FIG. 6: a diagram in perspective of an exemplary layout of the partial BFNs on the structural interface board, according to the invention.

As feeds are shared in only one direction of the focal array, the formation of the various beams may be implemented by using independent, linear partial BFNs that have no mutual overlap, each partial BFN, BFN1, BFN2, BFN3, being dedicated to the formation of one row of beams. The partial BFNs extend along the direction of the focal array that corresponds to the direction in which feeds are shared between adjacent groups, i.e. along the direction X in our example. Each partial BFN may then be manufactured in a modular form, each partial BFN comprising all of the power combiners 23*a*, 23*b* required for combining the ports of the RF feeds, in fours, in order to form a row of beams. The partial BFN extends in parallel to the port rows to be combined, has a width corresponding to the width of two port columns of the focal array and a length corresponding to the length of one row of the focal array. The focal array comprises one partial BFN per row of beams to be formed. Each partial BFN comprises a front face equipped with two input port rows that are arranged according to a matrix identical to that of two rows of through waveguides 31 of the structural interface board 30 and comprises a back face equipped with two, respectively transmission and reception, beam output ports, per group of four RF feeds. Thus, as shown in the diagram of FIG. 6, all of the partial BFNs, BFN1, BFN2, BFN3, are mounted side by side on a back face of the structural interface board 30, with no mutual overlap, and all of the input ports of the partial BFNs are connected to respective through waveguides that are integrated in the structural interface board. As each through waveguide is connected to a port of an RF feed belonging to a cluster source 15 that is mounted on the front face of the structural interface board 30, the input ports of each partial BFN are linked to respective ports of the RF sources that are integrated in the cluster sources via the through waveguides of the structural interface board. On the periphery of the focal array, there may be some available through waveguides 19 that are connected to ports of the RF feeds but which are not used to form the beams and hence not connected to the ports of a partial BFN. In this case, in order to absorb the RF energy radiated by the unused ports of the RF feeds, an absorbent material is inserted locally in the available through waveguides of the structural interface board, to which waveguides the unused ports are connected. Advantageously, the absorbent material contains carbon, such as, for example, silicon carbide.

This antenna architecture allows the radiofrequency feeds to be reused only in a single spatial dimension and requires the use of a second, identical antenna in order to obtain a good overlap of the beams in both spatial dimensions. This antenna architecture is therefore particularly simple as two adjacent beams are implemented by combinations of different ports, without using couplers, thereby allowing the use of independent power combiners dedicated to the formation of a single beam.

The structural interface board ensures the support, the assembly and the interconnections of all of the cluster sources and all of the partial BFNs on a single mating plane and allows complete decoupling of the various RF feeds that are integrated in the elementary cluster sources mounted on its front face and the various partial BFNs mounted on its back face. In contrast to conventional antenna architectures, the number of RF chains integrated in each cluster source is not fixed and may be freely adjusted depending on the form of the coverage to be implemented. Furthermore, it is possible to incorporate twisted through waveguides in the structural interface board. The structural interface board then allows RF chains and BFNs with waveguides of different cross sections, as well as waveguides with different orientations, to be connected, thereby allowing the design of the BFNs to be simplified. As the orientation of the ports of the RF chains is identical for all of the RF sources, this allows the routing of the power combiners within the partial BFNs in a plane parallel to the focal array to be made easier, without overlap between the partial BFNs, and the bulk of each RF feed and the size of the mesh of the focal array to be reduced.

Although the invention has been described in conjunction with particular embodiments, it is clearly evident that it is in no way limited thereto and that it comprises all of the technical equivalents of the described means, as well as combinations thereof if the latter fall within the scope of the invention.

The invention claimed is:

1. An antenna with multiple feeds per beam comprising a focal array equipped with a plurality of radiofrequency RF feeds and a beam forming network BFN, each RF feed comprising a radiating horn linked to an RF transmission and reception chain, two transmission ports respectively operating in two different polarizations that are orthogonal to one another and two reception ports respectively operating in said two different polarizations, the number of RF feeds per beam being equal to four, the focal array and the beam forming network being modular, the RF feeds being grouped into subassemblies that are respectively integrated in various cluster sources that are independent of one another, each comprising at least four RF feeds and the beam forming network BFN comprising multiple independent linear partial BFNs, the antenna furthermore comprising a single structural interface board comprising a front face on which the various cluster sources are mounted, positioned next to one another, and a back face on which the linear partial BFNs are mounted side by side, the structural board comprising a plurality of through waveguides that end on the two front and back faces to which, on the one hand, the various ports of the RF feeds of each cluster source and, on the other hand, corresponding ports of the linear partial BFNs are respectively connected, the corresponding ports of the RF feeds and of the linear partial BFNs being mutually linked via the through waveguides of the interface board.

2. The antenna according to claim 1, wherein each cluster source is composed of a stack of multiple planar layers, each planar layer being composed of two complementary metal half-shells that are assembled together, the two half-shells of each planar layer integrating radiofrequency components of the RF chains of all of the RF feeds of the cluster source, each RF chain being connected to a corresponding radiating horn.

3. The antenna according to claim 2, wherein the through waveguides of the interface board are respectively positioned according to a matrix with multiple rows and multiple columns and the transmission and reception ports of the RF chains all have the same orientation.

4. The antenna according to claim 1, wherein the adjacent RF feeds in the focal array have transmission ports and reception ports that are respectively linked in fours by power combiners integrated in the linear partial BFNs, two groups of four consecutive feeds in the focal array sharing two common feeds along a single direction of the focal array and the linear partial BFNs extend in parallel to said direction of the focal array corresponding to the sharing of feeds.

5. The antenna according to claim 4, wherein the interface board comprises, on the periphery of the focal array, available through waveguides that are connected to transmission and reception ports of RF feeds but not connected to ports of a linear partial BFN, said available through waveguides comprising an absorbent material containing carbon.

* * * * *